United States Patent [19]

Saito

[11] 4,062,383

[45] Dec. 13, 1977

[54] BAG TYING APPARATUS

[75] Inventor: Takashi Saito, Ueda, Japan

[73] Assignees: Meiko Commerce Co., Ltd., Tokyo; Nagano Technical Service Co., Ltd., both of Japan

[21] Appl. No.: 767,458

[22] Filed: Feb. 10, 1977

[30] Foreign Application Priority Data

Feb. 15, 1976 Japan ..... 51-16361[U]
Apr. 22, 1976 Japan ..... 51-46179

[51] Int. Cl.[2] ..... B21F 7/00; B21F 15/00

[52] U.S. Cl. ..... 140/93 A; 53/135; 53/198 A

[58] Field of Search ..... 53/135, 138 A, 198 A, 53/198 B; 140/93 A, 93.6, 119

[56] References Cited

U.S. PATENT DOCUMENTS

| | | | |
|---|---|---|---|
| 3,138,904 | 6/1964 | Burford | 53/135 X |
| 3,261,143 | 7/1966 | Platt et al. | 53/135 |
| 3,369,573 | 2/1968 | Baker et al. | 140/93.6 |
| 3,398,502 | 8/1968 | Halstead | 53/135 |
| 3,538,960 | 11/1970 | Tetrick | 140/93 |
| 3,825,039 | 7/1974 | Crabb | 140/93 A |

*Primary Examiner*—E. M. Combs
*Attorney, Agent, or Firm*—Flynn & Frishauf

[57] ABSTRACT

Bag tying apparatus for tying bags with a resilient tie. The apparatus comprises a tie wrapping plate and a tie twisting mechanism. The tie wrapping plate is linealy movable. The plate has a stepped groove which extends in the moving direction of the plate and an elongated recess which runs across the stepped groove. The resilient tie is placed on the bottom of the elongated recess, and bag is so positioned that its gathered neck to be tied is placed above the tie wrapping plate. As the plate is moved up by an air cylinder unit, the gathered neck of the bag is caught in the stepped groove of the plate. As the gathered neck of the bag enters the narrow section of the stepped groove, the resilient tie is gradually bent and finally substantially U-shaped.

The tie twisting mechanism comprises a twist shaft, a pair of twist hooks fixed to the lower end of the twist shaft, and a sprocket wheel secured to the upper end of the twist shaft. The sprocket wheel is turned by a chain the ends of which are connected to an air cylinder unit and a tension coil spring, respectively. The twist hooks engage with the respective ends of the U-shaped tie and twist the ends of the tie together when the sprocket wheel is turned, thereby tying the gathered neck of the bag with the resilient tie.

12 Claims, 6 Drawing Figures

BAG TYING APPARATUS

This invention relates to apparatus for tying bags, in particular to apparatus for tying with resilient ties the open tops of bags containing rolls, candies, cookies and the like.

One of the well-known bag tying apparatus of this type is provided with a U-shaped wrapping finger and a linkage for rotating the wrapping finger. The wrapping finger has a U-shaped groove. As the finger is rotated by the linkage, its lateral wall comes gradually into contact with a resilient tie and bend the tie in the form of letter U. As it is bent gradually, the tie is wrapped about the gathered neck of a bag to be tied. Thereafter the ends of the U-shaped tie are twisted together by a pair of twist hooks until the neck of the bag is tied up.

But such conventional tying apparatus is inevitably complicated in structure since the wrapping finger is rotated by a linkage, which is a complex mechanism. Further it is difficult with such conventional apparatus to vary the number of rotations of the twist hooks by a simple operation and, for example, in the tying apparatus according to U.S. Pat. No. 3,369,573 (S. M. Baker et al, Feb. 20, 1968) two bevel gears cooperate to rotate a twist shaft, and a torsion spring is wound about the shaft so as to re-rotate the shaft into the initial position. Necessarily provided with bevel gears and a torsion spring, this apparatus is rather massive. Since the torsion spring is twisted but to a limited degree, the twist shaft cannot be rotated a large number of times.

It is therefore an object of the invention to provide a bag tying apparatus which is compact and can twist a tie as many times as required.

One preferred embodiment of the invention comprises a tie wrapping plate and a tie twisting mechanism. The tie wrapping plate is linearly movable and has a stepped groove which extends in the moving direction of the plate and an elongated recess which runs across the stepped groove. The plate can be easily moved linearly up and down by an air cylinder unit which is provided below the plate. The gathered neck of a bag to be tied is placed above the tie wrapping plate, and a resilient tie is placed on the bottom of the elongated recess of the plate. As the plate is moved up, the tie is pressed onto the gathered neck of the bag, bent and U-shaped gradually. Thus, the gathered neck of the bag is partly wrapped by the U-shaped resilient tie.

The tie twisting mechanism comprises a twist shaft, a pair of twist hooks fixed to the lower end of the shaft, and a sprocket wheel secured to the upper end of the shaft. The sprocket wheel is turned by a chain, the ends of which are connected to an air cylinder unit and a tension coil spring, respectively. The twist hooks engage with the respective ends of the U-shaped tie. Thus, as the sprocket wheel is turned, the ends of the tie are twisted together, thereby to tie the gathered neck of the back.

Since the linear movement of the tie wrapping plate is effected by the air cylinder unit, the tying apparatus is made compact. In addition, since the chain is pulled by the air cylinder unit to various degrees while exerted with a bias force from the tension coil spring, the number of rotations of the twist shaft or twist hooks can be easily and accurately determined over a broad range.

Other objects, features and advantages of this invention will be clarified by the following description, when considered with reference to the accompanying drawings.

Figure 1:
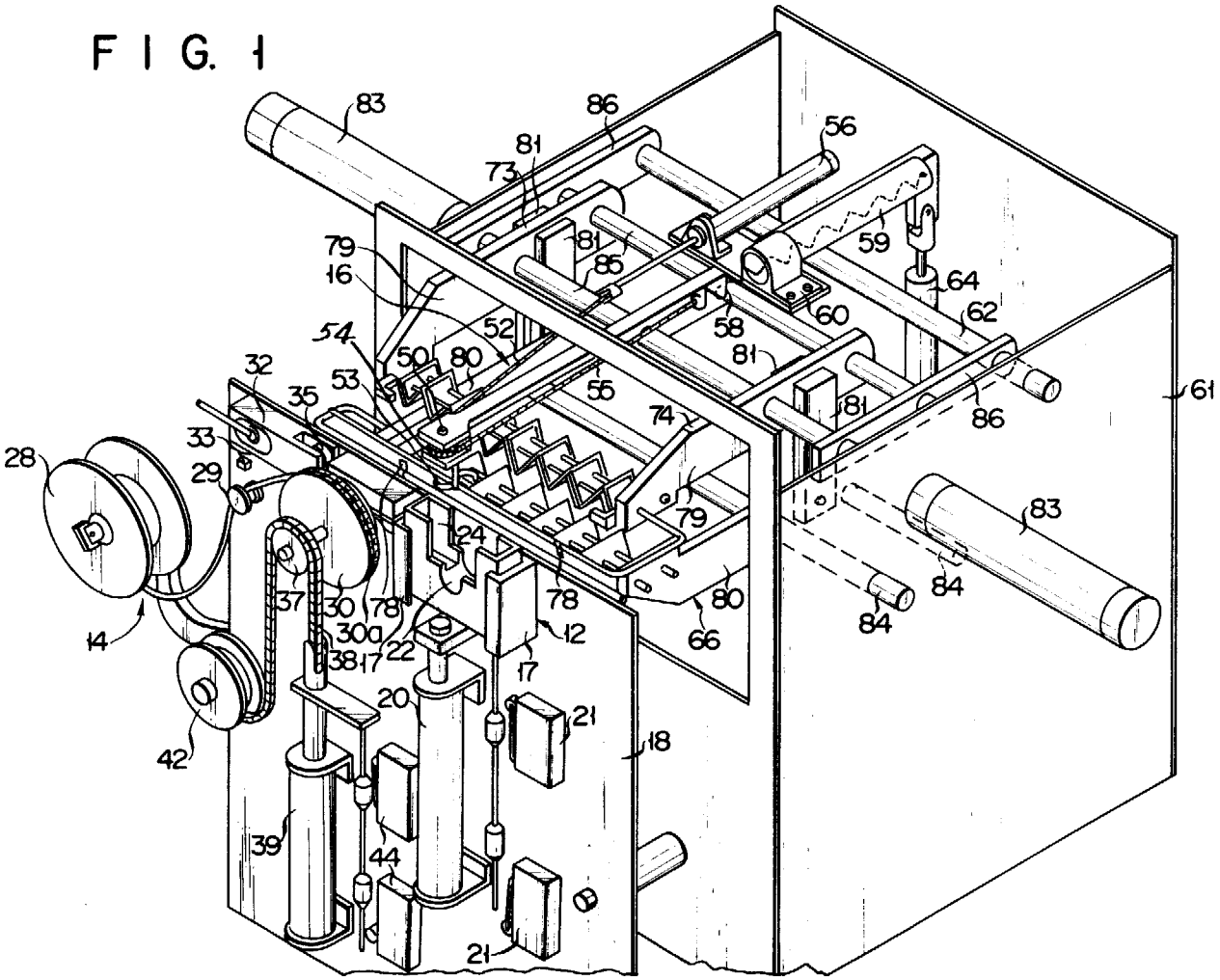
FIG. 1 is a schematic, perspective view of one preferred embodiment of this invention provided with a pleating mechanism.

As shown in FIG. 1, a bag tying apparatus 10 according to this invention comprises a tie wrapping plate 12 which is linearly movable, a tie feeder 14 which applies tie material automatically to the tie wrapping plate 12, and a twisting mechanism 16 which twists the ends of each tie together so as to tie up the open top of a bag.

Figure 2:
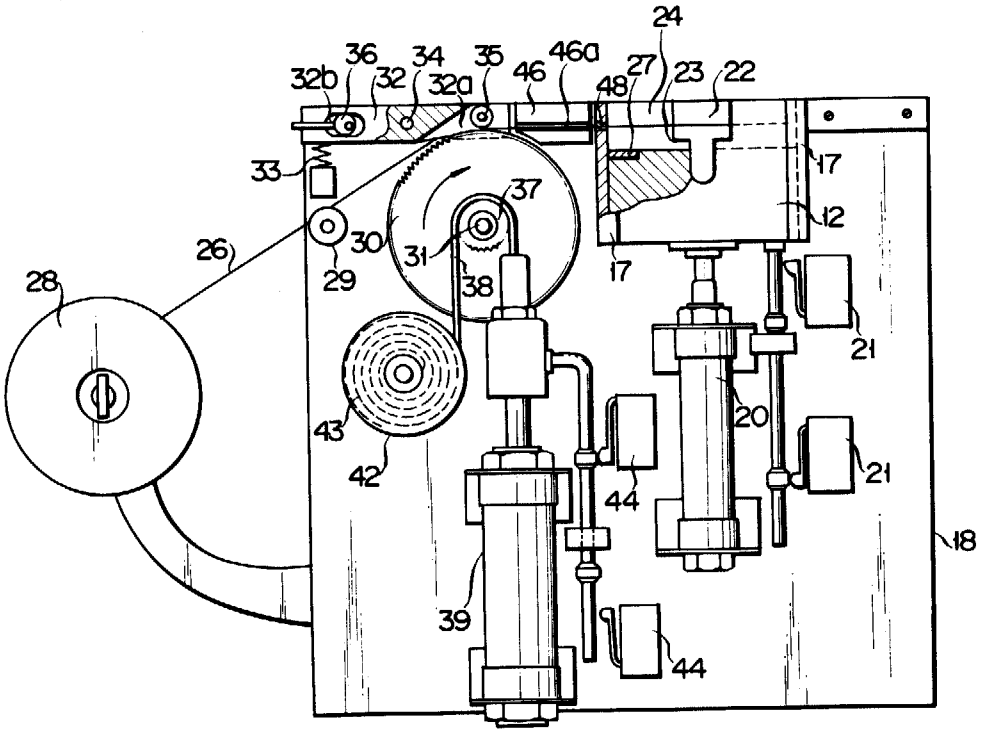
FIG. 2 is a schematic, front view of the tying apparatus shown in FIG. 1.
Figure 3:
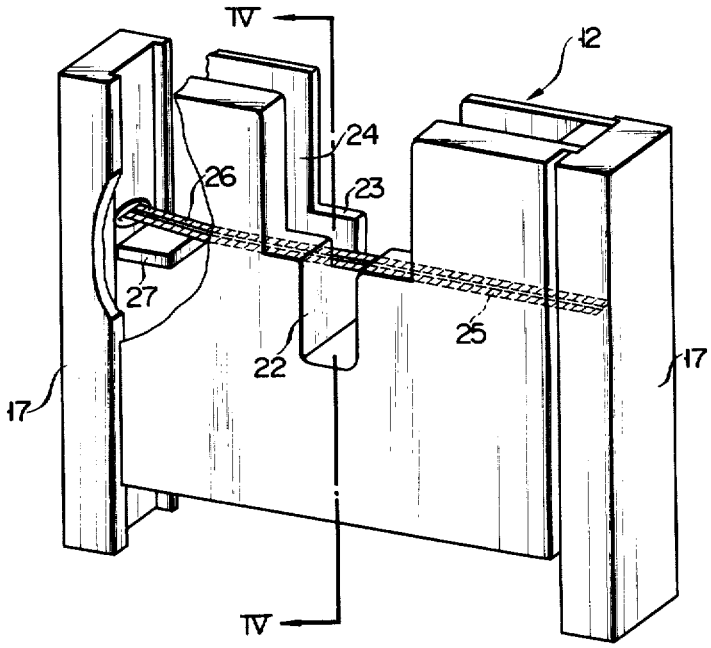
FIG. 3 is a perspective view of the tie wrapping plate, partly broken and at the lower position, of the apparatus shown in FIG. 1.
Figure 7:
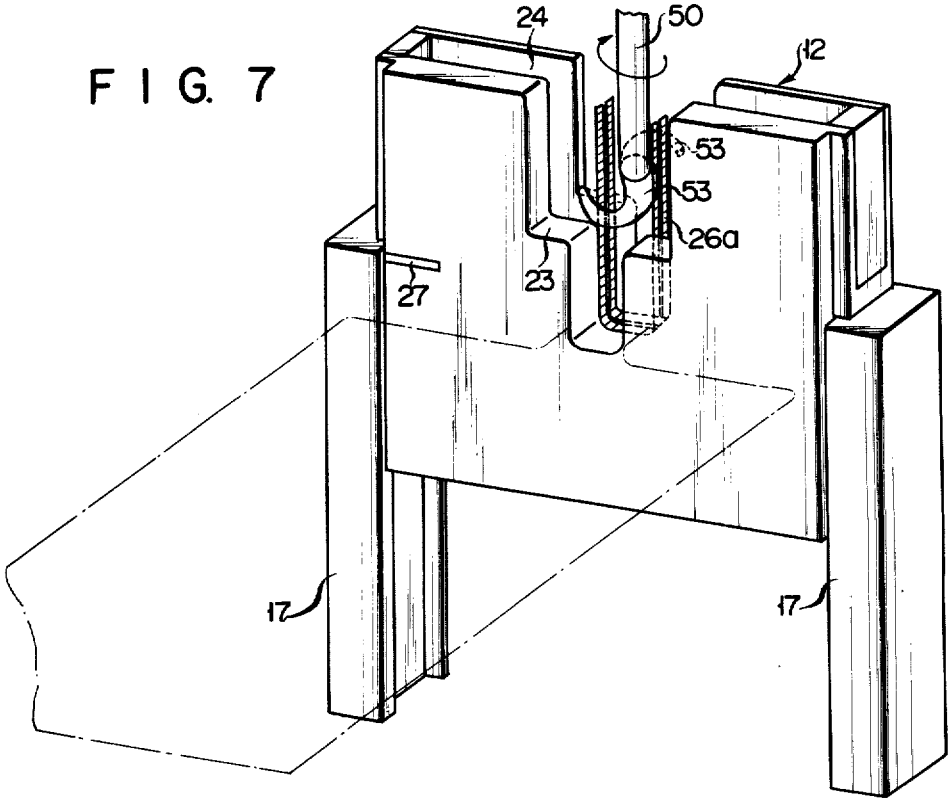
FIG. 7 shows how the resilient tie is twisted during the tie-twisting operation.
Figures 4, 5:
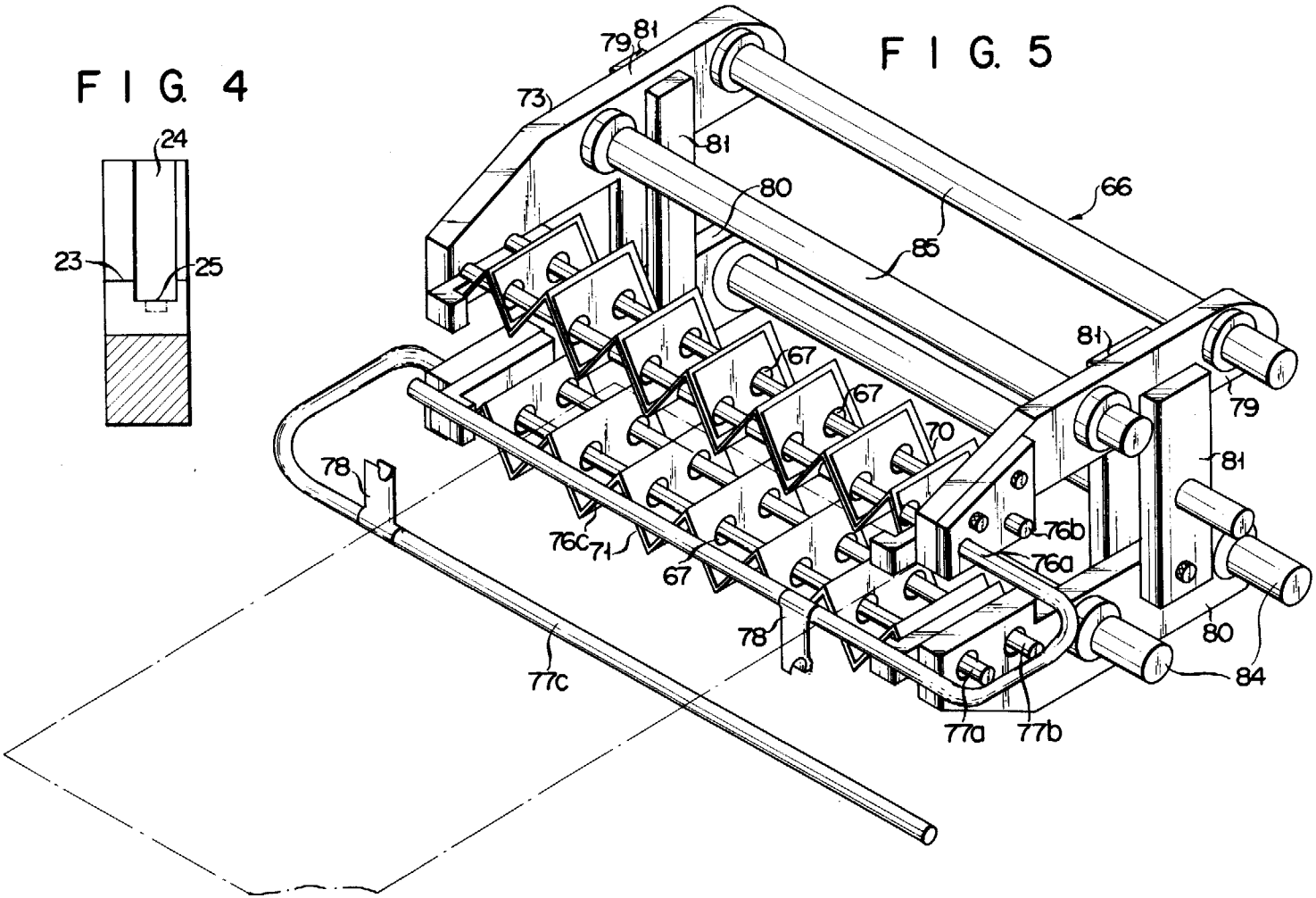
FIG. 4 is a cross-sectional view of the tie wrapping plate shown in FIG. 3, taken along line IV—IV in FIG. 3.
FIGS. 5 and 6 are schematic, perspective views of the pleating mechanism in non-operating condition and in operating condition, respectively.

As illustrated in FIGS. 1 and 2, the tie wrapping plate 12 is slidably supported between a pair of guide plates 17 secured to a front support plate 18. Below the plate 12 an air cylinder unit 20 is secured to the front support plate 18 and moves the plate 12 linearly up and down. Any other power source may replace the air cylinder unit 20. But an air cylinder unit is preferable since it promises a quite up-and-down movement of the plate 12 and helps to make the tying apparatus compact. The reciprocation of the piston of the air cylinder unit 20 is controlled by a pair of micro-switches 21 attached on the front support plate 18. As shown in FIG. 3, the tie wrapping plate 12 has a stepped groove 22 which extends in the moving direction of the plate and an elongated recess 24 which runs across the stepped groove 22. On the bottom 25 of the recess 24 the leading tip of resilient tie material 26 fed from the tie feeder 14 is placed. The elongated recess 24 is as broad as the tie material 26 so that the tie material 26 would not move sideways once placed in the recess 24. The bottom 25 of the recess 24 may be stepped as shown in FIG. 4 to have a narrower elongated recess. If such a narrower recess and the bottom 25 are made 4 mm and 8 mm wide, respectively, either a 4 mm-wide tie or an 8 mm-wide tie can be used without replacing the plate 12 by another tie wrapping plate having a different recess width. The bottom 25 of the elongated recess 24 may be formed broader so that a broader tie is used. Then, the broader tie serves a ribbon, and gives an aethetic feature to the bag, elevating the commercial value of the bag.

It is preferred that the bottom 25 of the recess 24 be positioned at the level below the shoulders 23 of the stepped groove 22. The bottom 25 being so positioned, the shoulders 23 guide the tie material 26 to prevent the same from moving sideways in the stepped groove 22, more effectively than otherwise.

On the front support plate 18 and on the left side of the tie wrapping plate 12, a tie cutter 27 is detachably fitted on the same level as the bottom 25 of the recess 24. When the plate 12 is moved upward, the tie cutter 27 severs a tie piece **26*a* from the tie material 26 fed from the tie feeder 14**.

As shown in FIGS. 1 and 2, the tie feeder 14 comprises a reel 28 on which the tie material 26 is wound many times, a guide roller 29 which guides the tie material 26 from the reel 28, a toothed roller 30 which receives the tie material 26 from the guide roller 29. The tie feeder 14 further comprises an arm 32 which extends substantially horizontal and which is disposed near the toothed roller 30. Urged by a compression coil spring 33, the arm 32 is rocked about a pivot 34 which is secured to the front support plate 18. A groove 32a is formed in that end of the arm 32 which is adjacent to the toothed roller 30. In the groove 32a there is disposed a small roller 35. Since the arm 32 is urged clockwise by the spring 33, the small roller 35 is pressed onto the toothed roller 30. Between the small roller 35 and the toothed roller 30 the tie material 26 is to be pinched.

The arm 32 has an elongated through hole 32b to the left of the pivot 34. Through the hole 32b an eccentric toggle bar 36 is rotatably attached to the front support plate 18. When the toggle bar 36 is rotated counterclockwise, the arm 32 is rocked counterclockwise against the bias force of the spring 33. Then the small roller 35 leaves the toothed roller 30 a little, and a gap is formed between the rollers 30 and 35. Into this gap the leading tip of the tie 26 is easily inserted.

On the shaft 31 of the toothed roller 30 there is fixed a toothed disc 37 such as a sprocket wheel, around which a chain 38 is wound. One end of the chain 38 is connected to a drive means 39 such as an air cylinder unit, and the other end to a spiral spring 43 housed in a roller 42. As the air cylinder unit 39 pulls the chain 38, the toothed roller 30 turns clockwise so as to feed the tie 26 to the tie wrapping plate 12. The air cylinder unit 39 is controlled by a pair of micro-switches 44 on the front support plate 18. If the air cylinder unit 39 is so controlled as to pull the chain 38 for a specific distance, the toothed roller 30 rotates by a specific angle thereby to feed a certain length of the tie 26 to the plate 12. When the air cylinder unit 39 is put into non-operative state, the roller 42 takes up the chain 38, rotated by the spiral spring 43. Thus, the chain 38 comes to assume its initial position, and so does the toothed roller 30. The sprocket wheel 37 functions as an idle pulley whenever it rotates counterclockwise. For this reason the toothed roller 30 would not rotate while the chain 38 is taken up by the roller 42. Thus, the tie material 26, once fed to the plate 12, will never retreat to the toothed roller 30. The leading tip of the tie material 26 is fed into the elongated recess 24 of the tie wrapping plate 12 via a guide passage 46a of a guide block 46 secured to the support plate 18 and via a slot 48 of the plate 12.

If the tie material 26 is a plastics strip with a wire which is, as shown in FIG. 3, embedded in the strip and extending along the center line of the strip, it is desired that the periphery of the toothed roller 30 have a center groove 30a to receive the wire. In this case the wire is never separated from the strip while the tie material 26 is pressed between the toothed roller 30 and the small roller 35 of the arm 32. Further, the groove 32a serves to effect centering of the tie material 26 with an embedded wire since it receives the wire. Thus, in case the periphery of the toothed roller 30 is 8 mm broad, the tie material 26, if narrower than the periphery of the roller 30, e.g. 4 mm broad, can be fed straight without moving sideways through the guide passage 46a and the slot 48 into the elongated recess 24 of the tie wrapping plate 12. Tie materials of different widths can therefore be replaced one with another merely by exhanging the reel 28 for another, as long as each tie material is narrower than the periphery of the toothed roller 30.

A length of the tie piece 26a inserted in the elongated recess 24 is cut by the cutter 27 from the tie material 26 when the tie wrapping plate 12 is moved up. The tie piece 26a thus severed from the tie material 26 is then placed on the bottom 25 of the recess 24.

The twisting mechanism 16 comprises, as shown in FIG. 1, a twist shaft 50 disposed above the narrow section of the stepped groove 22 of the tie wrapping plate 12 and rotatably attached to the front end of a supporting arm 52, a pair of twist hooks 53 secured to the lower end of the twist shaft 50, and a toothed disc 54 such as a sprocket wheel secured to the upper end portion of the twist shaft 50. Around the sprocket wheel 54 a chain 55 is wound to rotate the twist shaft 50. The ends of the chain 55 are connected to a drive means 56 such as an air cylinder unit and a tension coil spring 58, respectively. Both the air cylinder unit 56 and the tension coil spring 58 are attached to a support plate 60 which is secured to a frame 61. The frame 61 supports a pivot 62 rotatably. The pivot extends through the supporting arm 52. The rear end of the arm 52 is connected to a drive means 64 such as an air cylinder unit which is fixed to the frame 61 by means of an angle bar (not shown). The air cylinder unit 64 alternately pulls and pushes the rear end of the arm 52 so as to rock the arm 52 about the pivot 62.

If the open top of a bag has gathered by hands or by a pleating device, the tying apparatus of the above-mentioned construction can tie up the gathered neck, by wrapping a tie around the neck and twisting together the ends of the tie. But it is preferable that the tying apparatus should be provided with a pleating mechanism. If provided with a pleating mechanism, the apparatus can effect both tying and pleating operations on the bags continuously. For this reason the tying apparatus according to this invention may be further provided with a pleating mechanism 66 as shown in FIGS. 1.

As illustrated in FIGS. 1 and 5, the pleating mechanism 66 has a pair of pleating plates 70 and 71, which run parallel to each other horizontally and which are separated from each other vertically. Each pleating plate is bent in zigzag fashion to have several turns or sharp pleating teeth. The pleating teeth each have two through holes 67 formed on the same level. The pleating plates 70 and 71 are made of a plastics sheet, e.g. a polypropylene sheet so that each pleating tooth resiliently bends at its apex. Further, each pleating tooth is lined with a thin metal sheet so as to withstand hundreds of thousands of pleating operations without any fatique.

The ends of each pleating plate are fixed to brackets 73 and 74, respectively. A pair of parallel bars 76a and 76b pass through the holes 67 of the pleating teeth and are extended between the brackets 73 and 74. Similarly, another pair of parallel bars 77a and 77b pass through the holes 67 of the lower pleating teeth and are extended between the brackets 73 and 74. The bars 76a and 76b run horizontally and parallel to the bars 77a and 77b, spaced from the bars 77a and 77b for a distance. The pleating plates 70 and 71 therefore extend parallel to each other and are spaced from each other vertically for a specific distance.

The right ends of the bars 76a and 76b are fixed to the bracket 74, while the left ends are slidably fitted in the bracket 73. To the right end of the bar 76a there is connected a U-shaped bar 76c which lies at the same level as the bar 76a. By contrast, the left ends of the bars 77a and 77b are fixed to the bracket 73, while the right ends are slidably fitted in the bracket 74. To the left end of the bar 77*a* there is connected a U-shaped bar 77*c* which lies at the same level as the bar 77*a*. The U-shaped bars 76*c* and 77*c* may be integrally formed with the bars 76*a* and 77*a*, respectively. On each U-shaped bar there is slidably mounted a guide claw 78 which extends in vertical direction and which is constituted by a metal round bar covered and a plastics sheet covering the bar. The guide claws 78 cooperate to clamp the gathered neck of a bag so firmly that the shoulders of the bag are made perpendicular to the neck. The plastics cover serves to soften the impact between the gathered neck and each guide claws 78 thereby to avoid tearing of the bag.

The brackets 73 and 74 are each constituted by a pair of parallel arms 79 and 80 and a pair of connection plates 81. The lower ends of the connection plates 81 are fixed to the lower arm 80, as if to sandwich the same. The upper ends of the connection plates 81 define a space in which the upper arm 79 is slidably received. To the outer connection plate 81 of each bracket there is connected a drive means 83 such as an air cylinder unit. The lower arms 80 have two through holes each, through which a pair of parallel bars 84 extend slidably and horizontally and are secured to the frame 61. Similarly, the upper arms 79 have two through holes each, through which a pair of parallel bars 85 extend slidably and horizontally. But the parallel bars 85 are extended between two links 86. The rear ends of these links 86 are connected to the pivot 62.

It will now be described how the bag tying apparatus operates, assisted by the pleating mechanism of the above-mentioned construction.

Figure 6:
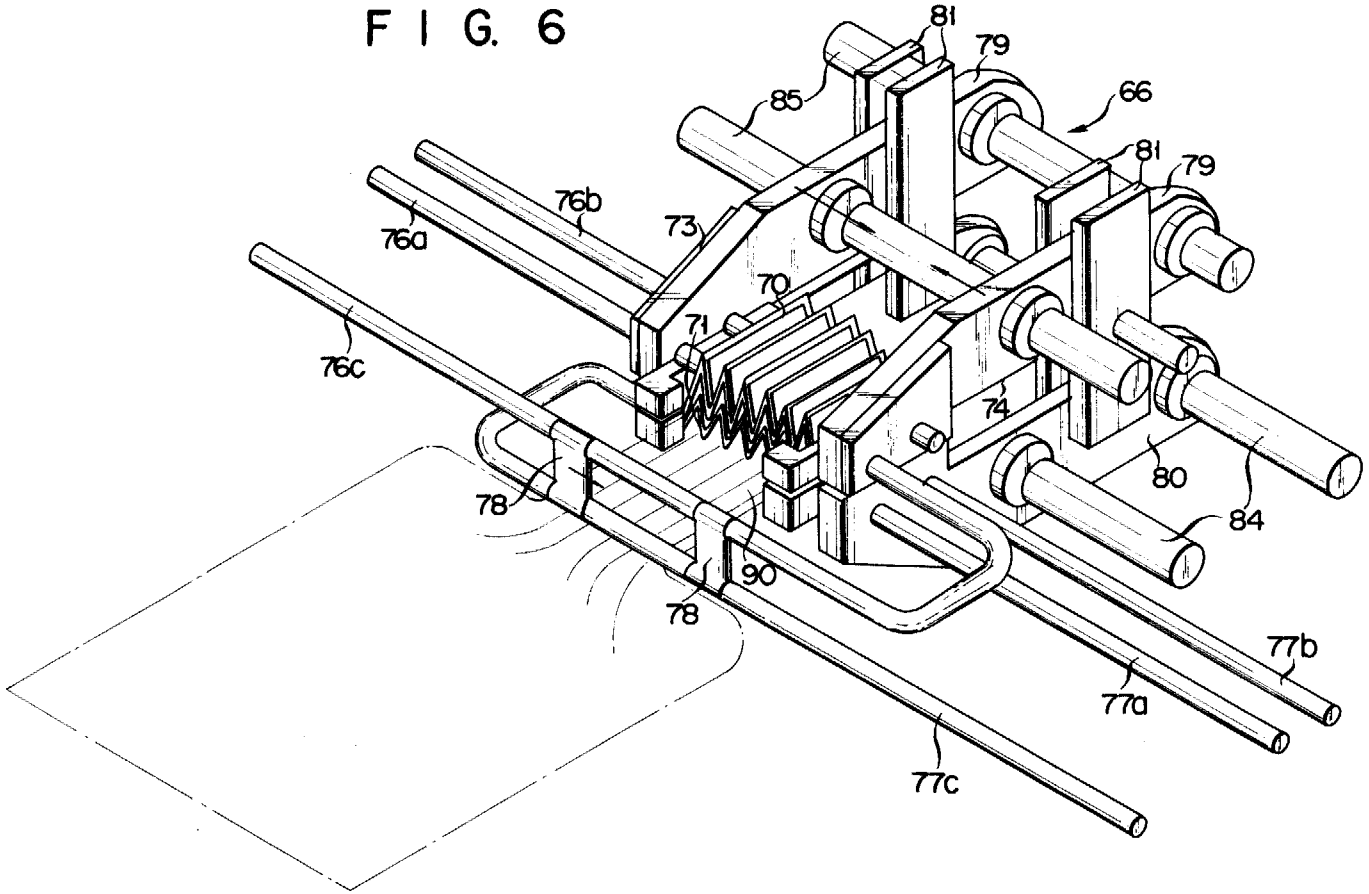

As shown in FIG. 5, the open top of a bag is inserted through between the guide claws 78 and between the U-shaped bars 76*c* and 77*c* until it is placed between the upper and lower pleating plates 70 and 71. The guide claws 78 may be slidably moved on the respective U-shaped bars, so that the distance between them is adjusted to the width of the bag. The supporting arm 52 secures the twist shaft 50 at the front end, is connected to the air cylinder unit 64 at the rear end, and is supported rockably on the pivot 62 at the middle portion. Thus, the supporting arm 52 is rocked about the pivot 62 to lower the twist shaft 50 when the air cylinder unit 64 is operated to push up the rear end of the arm 52. The upper parallel bars 85 pass through the supporting arm 52 and are extended between the upper arm 79. The upper arms 79 are rocked also about the pivot 62 to lower the upper pleating plate 70 when the rear end of the supporting arm 52 is pushed upward. When the upper pleating plate 70 is thus lowered, the open top of the bag is clamped between the upper pleating plate 70 and the lower pleating plate 71. Then the air cylinder units 83 are operated to push the connecting plates 81, respectively. As the connecting plates 81 are thus pushed, the open top of the bag is gathered gradually by the pleating plates 70 and 71 until it forms a gathered neck of the bag, as shown in FIG. 6. Concurrently, the parallel bars 76*a* and 76*b*are pushed to the left, while the parallel bars 77*a* and 77*b* to the right. As a result, the upper U-shaped bar connected to the bar 76*a* moves to the left, while the lower U-shaped bar connected to the bar 77*a* to the right, and the guide claws 78 on these U-shaped bars approach each other.

The open top of the bag is completely gathered and the gathered neck is firmly held between the guide claws 78. As a result, the shoulders of the bag become perpendicular to the neck, and the bag is so shaped as to give an impression that it is filled up with contents. The air cylinder unit 20 is then operated to move the tie wrapping plate 12 upward. As the plate 12 moves up, a length of the tie material 26 is severed by the cutter 27 from the tie feeder 14 and placed on the bottom 25 of the elongated recess 24 of the plate 12. At this time the gathered neck is positioned above the stepped groove 22 of the plate 12. Thus, as the plate 12 is further lifted, the neck of the bag is caught in the narrow section of the stepped groove 22 and bends the tie piece 26*a* severed from the tie material 26 in the form of letter U about the neck of the bag. At this stage the twist hooks 53 have been lowered by the air cylinder unit 64 to be engageable with the ends of the U-shaped tie 26*a*, respectively, but not to hit against them. Then, the air cylinder unit 56 is actuated to pull the chain 55 against the bias force of the tension coil spring 58. As a result, the sprocket wheel 54 is driven by the chain 55 to rotate the twist hooks 53. Thus the twist hooks 53 twist together the ends of the tie 26. Consequently, the gathered neck of the bag is tied up with the tie 26.

Upon completion of the tying operation, the air cylinder units 83 are so operated as to bring the brackets 73 and 74 back to their original positions. Thus, the pleating mechanism is made ready for the next pleating operation. The air cylinder unit 64 is so operated as to pull down the rear end of the supporting arm 52. Both the twist hooks 53 and the upper pleating plate 70 are therefore moved up to their initial positions. The air cylinder unit 56 is put into inoperative state to permit the tension coil spring 58 to pull the chain 55. Then, the air cylinder unit 20 is so operated as to pull down the tie wrapping plate 12 to its initial position. Thereafter, the air cylinder unit 39 is operated to pull the chain 38, thereby rotating the shaft 31 and thus the toothed roller 30 clockwise by a specific angle. Then, a specific length of tie material 26 clamped between the roller 30 and the small roller 35 is fed into the elongated recess 24 of the tie wrapping plate 12. In this way, the next twisting operation is made ready.

Since the tie wrapping plate 12 is moved linearly up and down by an air cylinder unit, not by a linkage, the above-described embodiment of this invention is made compact. In addition, the ends of a U-shaped tie 26*a* can be twisted as many times as desired accurately and over a broad range since the chain 55 is connected to the air cylinder unit 56 at one end and to the tension coil spring 58 at the other end and rotates the sprocket wheel 54 connected to the twist hooks 53 when it is controllably pulled by the air cylinder unit 56.

Air cylinder units 20, 39, 64 and 83 are employed to move the tie wrapping plate 12, the chain 38, the supporting arm 52 and the pleating plates 70 and 71, respectively. They may be replaced by oil cylinder units or cam mechanisms. Further, the chain 38 and the sprocket wheel 37 may be replaced by a toothed belt and a toothed pulley. Similarly, the chain 55 and the sprocket wheel 54 may be replaced by a toothed belt and a toothed pulley.

What is claimed is:

1. Bag tying apparatus for tying up a gathered neck of a bag with a tie, comprising:

a tie wrapping plate moveable linearly over a predetermined stroke and having a stepped groove extending in the moving direction of the wrapping plate, the stepped groove having a narrow section for receiving a gathered neck of a bag, and an elongated recess running across the stepped groove, the elongated recess having a bottom on which to receive a tie material;

a pleating mechanism disposed above and behind said wrapping plate in the moving direction thereof and for clamping the open end of the bag into pleats and for then gathering the pleated open end of the bag into a gathered neck, a cutter disposed on one side of said wrapping plate and being movable together with said wrapping plate so as to cut a tie of a predetermined length from said tie material on said bottom of said elongated recess during the initial stage of the moving stroke of said wrapping plate, said tie being bent into a U-shape as the gathered neck of the bag comes into said narrow section of the stepped groove during the final stage of the moving stroke of said wrapping plate; and a tie twisting mechanism arranged above said wrapping plate, said tie twisting mechanism including a twist shaft which is rotatable but immovable in the axial direction thereof, said twist shaft having upper and lower end portions, a pair of twist hooks secured to a lower end portion of the twist shaft and engageable with the ends of the U-shaped tie, and a toothed disc secured to the upper end portion of the twist shaft, the twist hooks being adapted to twist the ends of the U-shaped tie when the toothed disc is rotated, to thereby tie up the gathered neck of the bag.

2. Bag tying apparatus according to claim 1, wherein said pleating mechanism includes:

pleating means having a pair of pleating plates, each plate being bent in zigzag fashion to form pleating teeth each of which has two through holes on the same level, a pair of first parallel bars extending through the holes of the teeth of one pleating plate, and a pair of second parallel bars extending through the holes of the pleating teeth of the other pleating plate;

bracket means including a first bracket for fixedly securing one end of each pleating plate and one end of each first parallel bar and for slidably supporting one end of each second parallel bar; and a second bracket for fixedly securing the other end of each pleating plate and the other end of each second parallel bar and for slidably supporting the other end of each first parallel bar; and drive means for causing said pleating plates to seize between them the open top of a bag and to then pleat the seized open top of the bag into a gathered neck.

3. Bag tying apparatus according to claim 2, further comprising first and second U-shaped bars, one of said first parallel bars being connected at the fixed end thereof to said first U-shaped bar which extends parallel to, and at the same level as, said first bar, and one of said second parallel bars being connected at the fixed end thereof to said second U-shaped bar which extends parallel to, and at the same level as, said second bar; and a pair of guide claws mounted perpendicular to said U-shaped bars, respectively, and spaced from each other by a distance which corresponds to the width of the open top of a bag to be seized between the pleating plates.

4. Bag tying apparatus according to claim 3, wherein said guide claws each comprise a metal round bar and a plastic sheet covering the metal round bar.

5. Bag tying apparatus according to claim 2, wherein said pleating plates comprise a bent plastic sheet.

6. Bag tying apparatus according to claim 5, wherein said plastic sheet is of polypropylene.

7. Bag tying apparatus according to claim 5, wherein at least one side of each pleating plate is lined, except for the bending portions thereof, with a thin metal plate.

8. Bag tying apparatus according to claim 2, wherein said stepped groove has shoulders, and said bottom of the elongated recess is positioned at a level below said shoulders of said stepped groove.

9. Bag tying apparatus according to claim 8, wherein the bottom of said elongated recess is stepped so as to receive ties of different widths.

10. Bag tying apparatus according to claim 2, wherein said cutter is mounted on one side of said wrapping plate on the same level as the bottom of said elongated recess.

11. Bag tying apparatus according to claim 1, comprising a source of tie material for feeding tie material to said bottom of said elongated recess.

12. Bag tying apparatus according to claim 11, wherein said source comprises means for receiving a reel of tie material and for feeding tie material from said reel to said bottom of said elongated recess.

* * * * *